US010369689B2

(12) United States Patent
Ballard

(10) Patent No.: US 10,369,689 B2
(45) Date of Patent: Aug. 6, 2019

(54) ADJUSTABLE UNIVERSAL HARDWARE INSTALLATION AND MACHINING JIG FOR CARPENTRY APPLICATION

(71) Applicant: McKay Ballard, Pleasant Grove, UT (US)

(72) Inventor: McKay Ballard, Pleasant Grove, UT (US)

( * ) Notice: Subject to any disclaimer, the term of this patent is extended or adjusted under 35 U.S.C. 154(b) by 221 days.

(21) Appl. No.: 15/469,339

(22) Filed: Mar. 24, 2017

(65) Prior Publication Data

US 2018/0272521 A1 Sep. 27, 2018

(51) Int. Cl.
*B25H 7/00* (2006.01)

(52) U.S. Cl.
CPC ..... *B25H 7/00* (2013.01)

(58) Field of Classification Search
CPC ..... B25H 7/02; B25H 7/04; B25H 1/0092; B25H 7/00; B25H 7/045; B25H 1/0021; B25H 1/0078; B25H 1/02; B25H 1/04; B25H 1/06; E04F 21/003; E04F 21/0007; E05N 17/06; E05D 11/0009; Y10T 29/4984
USPC ..... 33/419, 425, 427, 428, 452, 464; 269/287, 288
See application file for complete search history.

(56) References Cited

U.S. PATENT DOCUMENTS 2,872,735 A * 2/1959 Roberts ..... B43L 13/048 33/427
4,713,887 A * 12/1987 Kitamura ..... B23Q 1/621 33/1 M
5,311,791 A * 5/1994 Yanagisawa ..... B23Q 1/621 108/143
5,743,684 A * 4/1998 Rex ..... B23B 47/287 408/115 R
9,751,206 B1 * 9/2017 Nelson ..... B25H 7/04

* cited by examiner

*Primary Examiner* — William V Gilbert
(74) *Attorney, Agent, or Firm* — Steven Rinehart

(57) ABSTRACT

An adjustable universal carpentry jig for manipulating a workpiece, the jig having a rectangular base, the base defining a plurality of guide tracks within which a detachable adjustment arm travels for precise measurement of the workpiece. The adjustment arm comprises a plurality of clamps or clasps for affixing the adjustment arm to the base.

5 Claims, 6 Drawing Sheets

ADJUSTABLE UNIVERSAL HARDWARE INSTALLATION AND MACHINING JIG FOR CARPENTRY APPLICATION

BACKGROUND OF THE INVENTION

Field of the Invention

This invention relates to carpentry and cabinetmaking and more particularly relates to a jig for wood templets.

Description of the Related Art

Jigs are known throughout the art for assisting carpenters in milling or machining a templet (such as a strike plate cutout), doors, and other workpieces. Carpentry requires precise and expeditious measuring, reliable tools, and mistakes can be costly. Tape measures and other measuring devices such as squares have traditionally been used by carpenters, but are only of limited efficiency in modern carpentry. Many carpentry devices are used not to cut, drill, saw, bevel or carve work pieces, but rather to mark them for subsequent application of cutting tools.

Integration of complicated design into workpieces has become more common as has the time required of carpenters to successfully complete a job. Measuring and marking of workpieces can be burdensome and errors can render a workpiece useless. Retaining a workpiece in a vice for precision measuring operation is impractical for most workpieces. Makeshift arrangements are commonly utilized, none of which provide optimal benefit.

In fine carpentry work, many carpentry operations have to be performed as close to perpendicularity as possible with respect to the surface of a workpiece and the edges of workpieces. In the case of hardware installed on a door or cabinet doors of the kind used in kitchens and bathrooms, for example, small aperpendicularity can cause asymmetry after installation, unhappy customers, unnecessary material costs and lost margins.

While angular templets (or templates) are available for measuring and machining, including applying and marking, including miter lines and cutting lines, there are no universal jigs available. A universal jig is needed which can be utilized to more efficiently facilitate measuring, machining and working of planar wooden surfaces including doors. None are known in the art which accomplish the functions of the disclosed invention herein.

In summary, the lack of adequate solutions to the abovementioned problems remain unsolved. No apparati or methods which have heretofore been designed cure the inefficiencies in the art. As a result, there is a need for the adjustable carpentry jig provided below.

SUMMARY OF THE INVENTION

From the foregoing discussion, it should be apparent that a need exists for an adjustable carpentry jig. Beneficially, such an apparatus would overcome many of the difficulties and concerns expressed above.

The present invention has been developed in response to the problems and needs in the art that have not yet been fully solved by currently available apparati and methods. Accordingly, the present invention has been developed to provide an adjustable carpentry jig comprising: a rectangular base having a top surface and bottom surface, the top surface of the base defining pair of parallel guide tracks within which an adjustment arm can travel; wherein the base defines a hollow rectangular, interior recess for detachably receiving a workpiece; wherein the base comprises an uninterrupted cantilevered abutment templet circumscribing the interior recess for abutting the workpiece; and a detachable adjustment arm for traveling within two or more guide tracks, the detachable adjustment arm having a planar top surface which abuts one of the top surface and bottom surface of the base, the planar top surface of the adjustment arm defining a recess for spacing the adjustment arm from the workpiece.

In some embodiments, the bottom surface of the adjustable carpentry jig of the base defines a pair of parallel guide tracks within which the adjustment arm can travel. The adjustment arms may travel laterally from one side of the jig to another.

The adjustment arm may comprise a plurality of clasps for affixing the adjustment arm to the base.

The adjustment arm may define a second templet recess for receiving a second templet. The adjustment arm may define one or more bevel offset recesses.

These features and advantages of the present invention will become more fully apparent from the following description and appended claims, or may be learned by the practice of the invention as set forth hereinafter

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It is an object of the present invention to provide a jig, or templet housing unit, with an adjustable guide or arm for centering a templet inserted into the jig.

Figure 1:
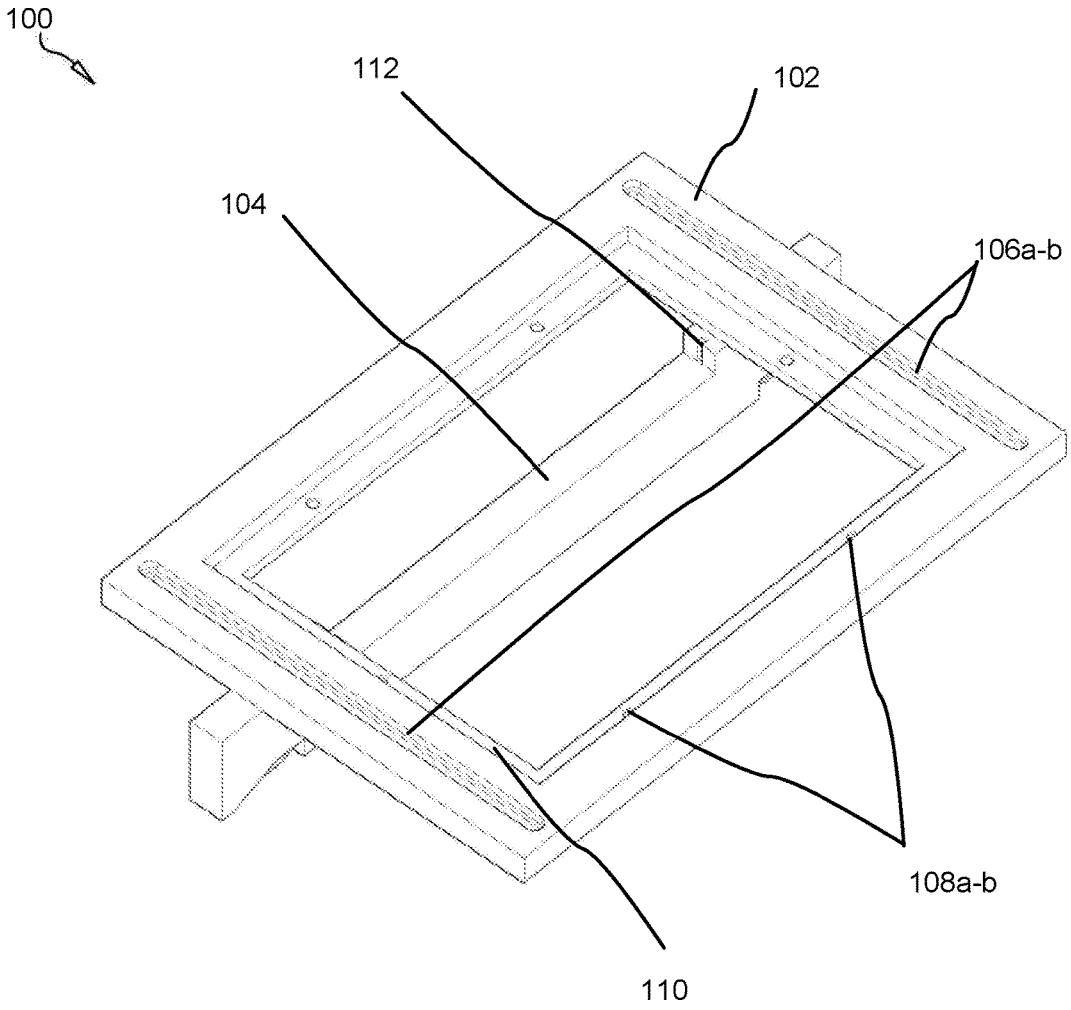
FIG. 1 is top-side perspective view of an adjustable carpentry jig in accordance with the present invention.

FIG. 1 is top-side perspective view of an adjustable carpentry jig 100 in accordance with the present invention. The jig 100 comprises a base 102, an adjustable arm 104 defining a chip board securement groove 112, guide tracks 106*a-b*, linearly-arranged holes 108*a-b*, and a templet abutment.

The base 102 comprises a templet housing unit for securing a templet in place on a x and y axis. The base 102 may comprise one or more magnets for securing the inserted templet on a z axis as well.

The base 102 is provided with a templet abutment 110 recessed beneath a top surface of the base 102 in the form of a cantilevered lip circumscribing in rectangular form the interior edge of the base 102.

The base 102 as shown is fabricated from extruded aluminum, but may be fabricated in other embodiments from wood, steel, or polymeric materials.

The adjustment arm 104 is slidable affixed to the base 102 to travel laterally along a horizontal axis in two guide tracks 106*a-b*. The adjustment arm 104 may is detachable and may affix slidably to either the top surface or bottom surface of the base 102. In the shown embodiments, the adjustment arm is detachably affixed to the bottom surface. The adjustment arm 104 is affixable in position above or below a templet or workpiece received by the base 102. The templet or workpiece may then be precision milled, machined, contoured, routed, drilled or otherwise manipulated by a carpenter.

Figure 2:
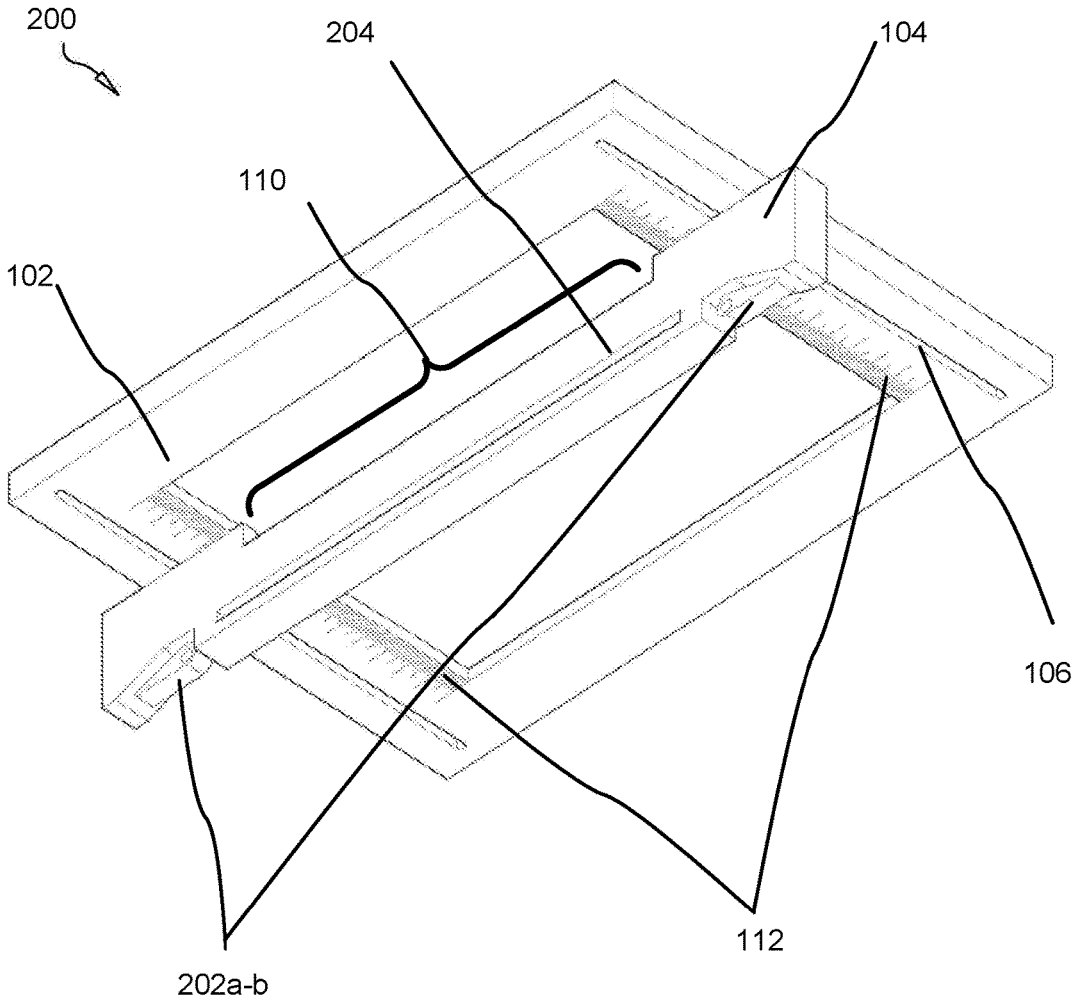
FIG. 2 is bottom-side perspective view of an adjustable carpentry jig in accordance with the present invention.

FIG. 2 is bottom-side perspective view of an adjustable carpentry jig 200 in accordance with the present invention. The jig 200 comprises a base 102, an adjustment arm 104 comprising a recess 110, defining a bevel offset recess 204 and having clasps 202*a-b*. The base 102 defines two guide tracks 106 within which the adjustable arm 104 travels. Marking 112 is printed, etched, engraved, adhered or otherwise visibly depicted on the bottom surface of the base 102 for measuring a distance from inside interior edge of the base 102 to the adjustment arm 104.

The recess 110 functions, inter alia, to allow a bit on a router to engage the workpiece between the adjustment arm 104 and a bottom or top surface of the workpiece. The recess 110 also is adapted to receive a sacrificial blow out board, or chip board, for abutting and bracing an edge of the workpiece and preventing chips or blow out to the edge of the workpiece caused by cutting, machining or drilling operations near the edge of the workpiece. The adjustment arm comprises a chip board securement groove 112 receiving a corresponding protrusion on a chip board (as shown in relation to FIG. 1 above).

Figure 3A:
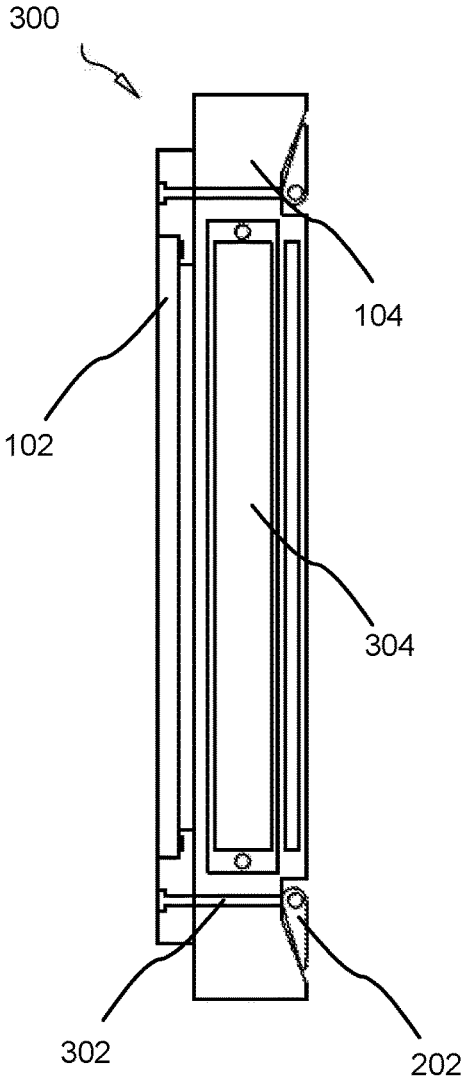
FIG. 3A is side perspective view of an alternate embodiment of an adjustment arm of an adjustable carpentry jig in accordance with the present invention.

FIG. 3A illustrates side perspective views of an alternative embodiment of an adjustment arm 300 of an adjustable carpentry jig in accordance with the present invention. In this alternative embodiment, the adjustment arm 104 defines a second recess, or second templet recess 304, for receiving a second templet. This second templet may be used for drilling or machining operations to the edge of a door or workpiece received by the base 102, including lock installation operations.

Figure 3B:
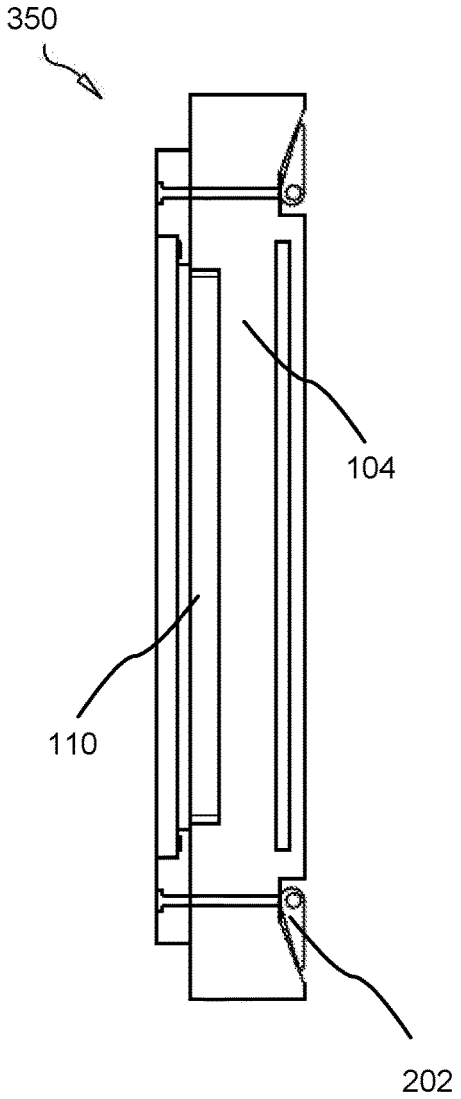
FIG. 3B is side perspective view of adjustment arm of an adjustable carpentry jig in accordance with the present invention.

FIG. 3B illustrates side perspective views of adjustment arm 350 of an adjustable carpentry jig in accordance with the present invention. The jig 300 comprises a base 102 and an adjustment arm 104 having a clasp 202.

The clasp 202 comprises a bolt 302 which traverses the base 102 on its z axis and travels within the guide track 106. The clasp 202 may comprise a clamp as known to those of skill in the art.

The bevel offset recess serves to receive a rubber insert, or adjustable rubber insert, adapted to facilitate the angling of a strike edge of a door. The rubber insert tilted the workpiece and allows a carpenter or operator to change the angle of the strike edge.

Figure 4:
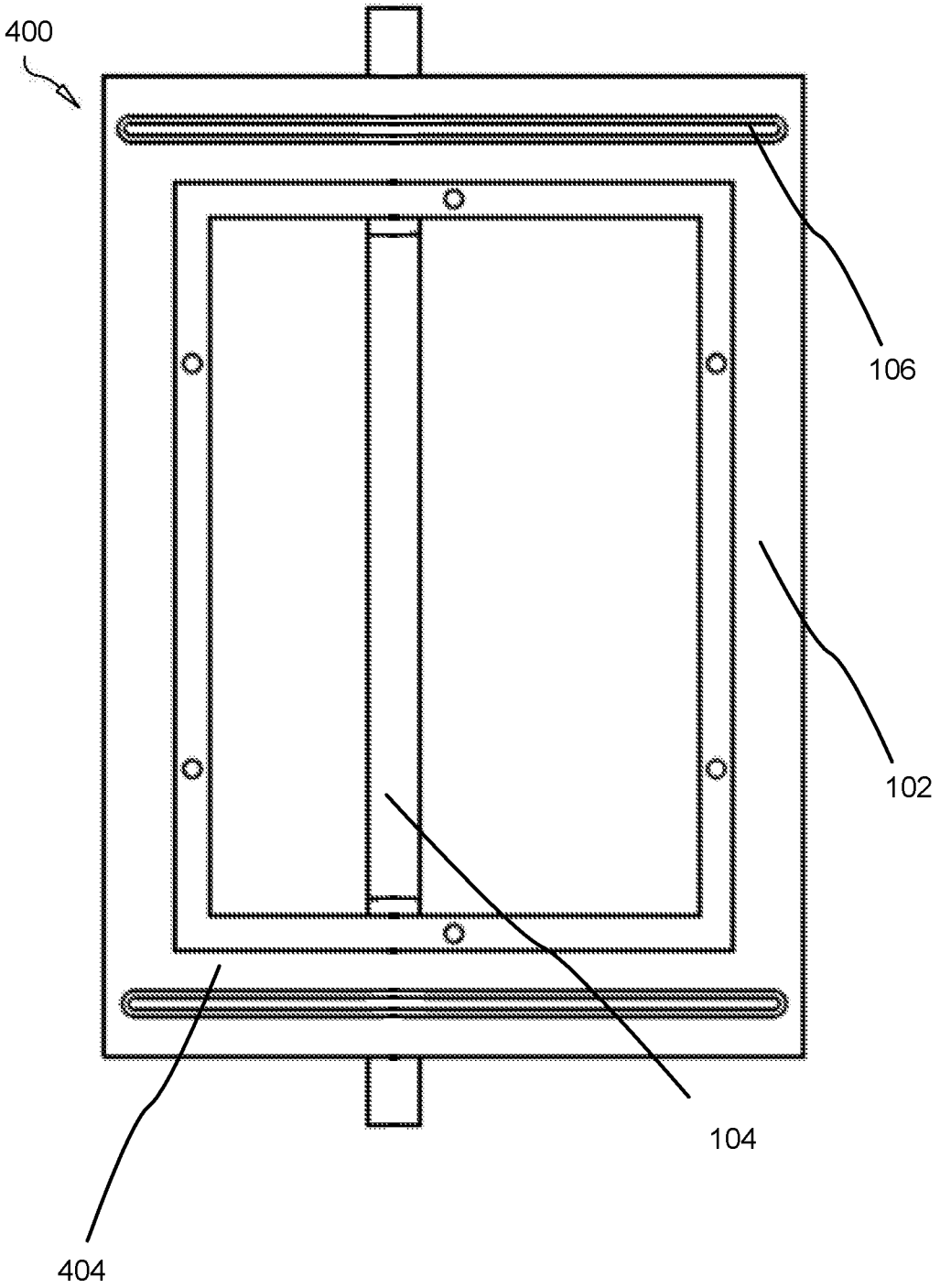
FIG. 4 is lower perspective view of an adjustable carpentry jig in accordance with the present invention.

FIG. 4 is lower perspective view of an adjustable carpentry jig 400 in accordance with the present invention. The base 102 of the jig 400 comprises a top surface 404.

Figure 5:
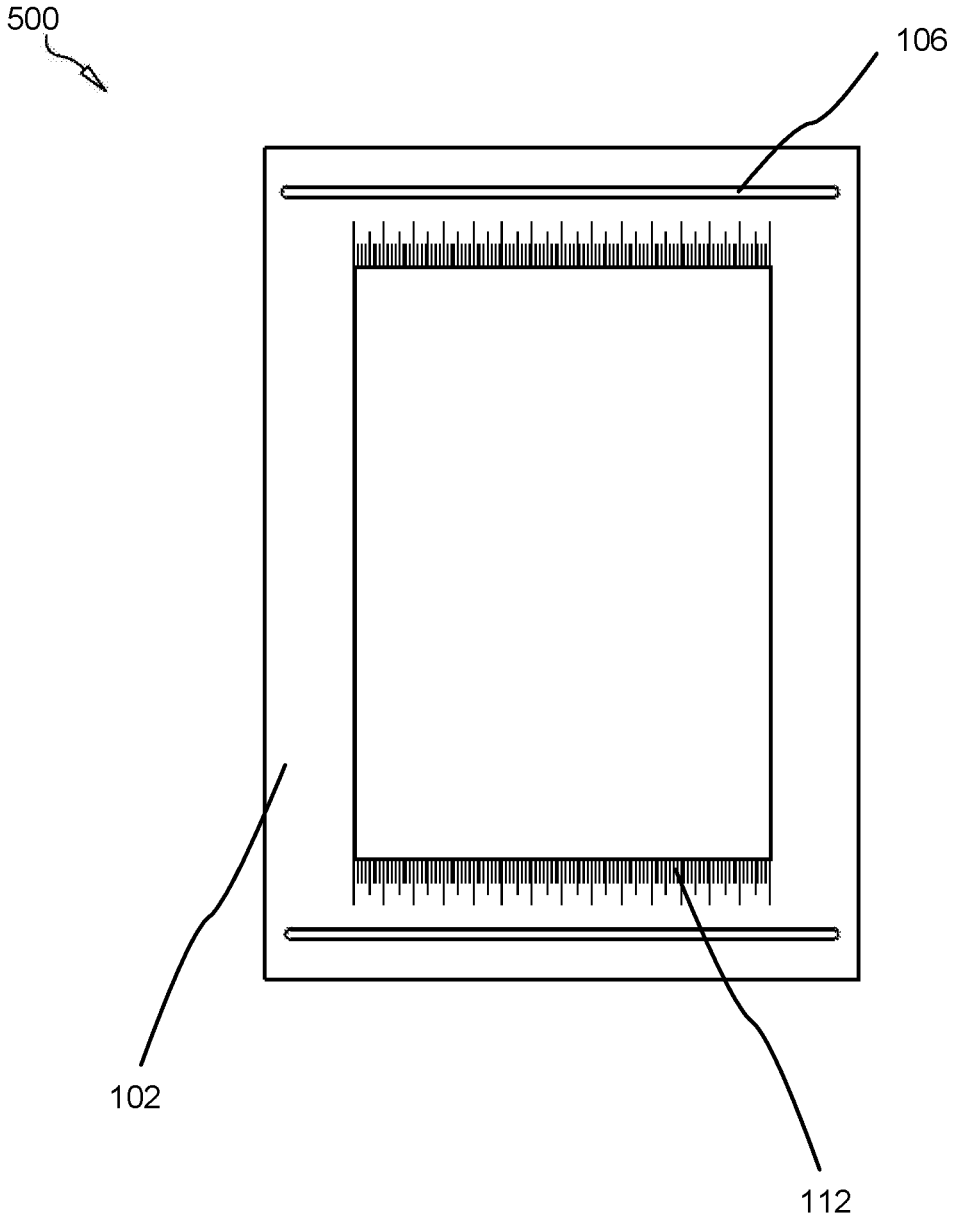
FIG. 5 is lower perspective view of an adjustable carpentry jig with detached adjustment arm in accordance with the present invention.

FIG. 5 is lower perspective view of an adjustable carpentry jig 500 with detached adjustment arm in accordance with the present invention. The jig 500 comprises marking 112 as shown.

Figure 6A:
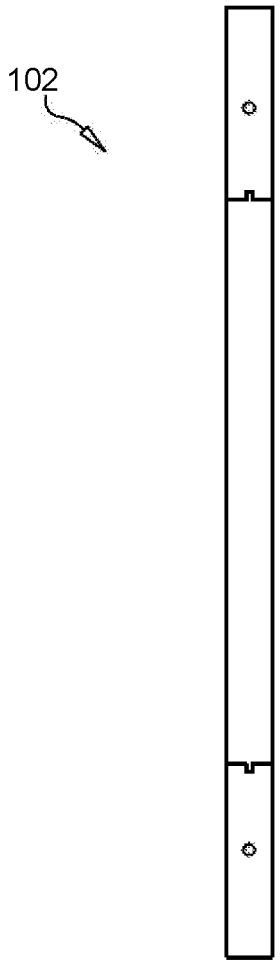
FIG. 6A is side perspective view of an adjustable carpentry jig with detached adjustment arm in accordance with the present invention.

FIG. 6A is side perspective view of an adjustable carpentry jig 600 with detached adjustment arm in accordance with the present invention.

The base 102 may comprise four sides affixed together as shown.

Figure 6B:
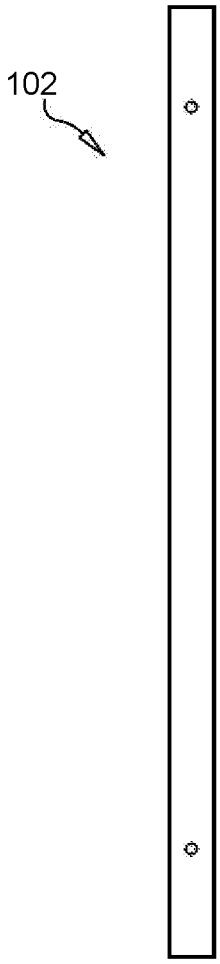
FIG. 6B is side perspective view of an adjustable carpentry jig with detached adjustment arm in accordance with the present invention.

FIG. 6B is a side perspective view of an adjustable carpentry jig with detached adjustment arm in accordance with the present invention.

As shown.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An adjustable carpentry jig comprising:

a rectangular base having a top surface and bottom surface, the top surface of the base defining a pair of parallel guide tracks within which an adjustment arm can travel;

wherein the base defines a hollow rectangular, interior recess for detachably receiving a workpiece;

wherein the base comprises an uninterrupted cantilevered abutment templet circumscribing the interior recess for abutting the workpiece; and a detachable adjustment arm, the detachable adjustment arm having a planar top surface which abuts one of the top surface and bottom surface of the base, the planar top surface of the adjustment arm defining a recess for spacing the adjustment arm from the workpiece.

2. The adjustable carpentry jig of claim 1, wherein the bottom surface of the base defines a pair of parallel guide tracks within which the adjustment arm can travel.

3. The adjustable carpentry jig of claim 1, wherein the adjustment arm travels laterally from one side of the jig to another.

4. The adjustable carpentry jig of claim 1, wherein the adjustment arm comprises a plurality of clasps for affixing the adjustment arm to the base.

5. The adjustable carpentry jig of claim 1, wherein the adjustment arm defines a second templet recess for receiving a second templet.

* * * * *